US012595674B2

(12) United States Patent
Capasso

(10) Patent No.: US 12,595,674 B2
(45) Date of Patent: Apr. 7, 2026

(54) SELF-SUPPORTING LOCULUS

(71) Applicant: LASEF S.R.L., Manerbio (IT)

(72) Inventor: Crescenzo Capasso, Manerbio (IT)

(73) Assignee: LASEF S.R.L., Anerbio (IT)

( * ) Notice: Subject to any disclaimer, the term of this patent is extended or adjusted under 35 U.S.C. 154(b) by 119 days.

(21) Appl. No.: 18/262,664

(22) PCT Filed: Dec. 27, 2021

(86) PCT No.: PCT/IB2021/062341

§ 371 (c)(1),
(2) Date: Jul. 24, 2023

(87) PCT Pub. No.: WO2022/157581

PCT Pub. Date: Jul. 28, 2022

(65) Prior Publication Data

US 2024/0076894 A1 Mar. 7, 2024

(30) Foreign Application Priority Data

Jan. 25, 2021 (IT) ..... 102021000001241

(51) Int. Cl.
*E04H 13/00* (2006.01)

(52) U.S. Cl.
CPC ..... *E04H 13/006* (2013.01)

(58) Field of Classification Search
CPC .. E04H 13/006; A61G 17/007; A61G 2203/76
USPC ..... 52/134, 136, 137
See application file for complete search history.

(56) References Cited

U.S. PATENT DOCUMENTS 2,080,190 A * 5/1937 Sinner ..... E04H 13/006 52/509
2,162,435 A * 6/1939 Hopkins ..... E04H 13/00 52/141
2,574,938 A * 11/1951 Sinner ..... E04H 13/006 52/378
3,905,169 A * 9/1975 Gallo ..... E04F 19/08 52/235

(Continued)

FOREIGN PATENT DOCUMENTS

BR 102018011313 A2 12/2019
ES 2536333 A1 5/2015
WO WO95/31624 A1 11/1995

OTHER PUBLICATIONS

WIPO, European International Search Authority, International Search Report and Written Opinion mailed Apr. 8, 2022 in International Patent Application No. PCT/IB2021/062341, 9 pages.

*Primary Examiner* — Christine T Cajilig
(74) *Attorney, Agent, or Firm* — MASUVALLEY & PARTNERS; Peter Martinez

(57) ABSTRACT

A modern loculus made in one piece, i.e. devoid of joints or welding, of a plastic or polymeric material is described. The loculus is self-supporting and does not require an outer supporting rack. This result is achieved by implementing at least the vertical side walls with ribs or ribbing, or by implementing the vertical side walls corrugated. The loculus is stackable with the leaning base supported by the upper wall of the underlying loculus and the leaning base is inclined towards the bottom wall and defines a tank for collecting liquids. The upper wall is inclined towards the bottom wall with the same inclination as the leaning base.

13 Claims, 6 Drawing Sheets

(56) References Cited

U.S. PATENT DOCUMENTS

| | | | | |
|---|---|---|---|---|
| 5,894,699 | A | 4/1999 | Fulton et al. | |
| 2008/0196225 | A1* | 8/2008 | Pruitt ..... | A61G 17/0405 27/1 |

* cited by examiner

SELF-SUPPORTING LOCULUS

RELATED APPLICATIONS

This application is the U.S. National Phase of and claims priority to International Patent Application No. PCT/IB2021/062341, International Filing Date Dec. 27, 2021, entitled Self-Supporting Loculus; which claims benefit of Italian Application No. 102021000001241 filed Jan. 25, 2021 entitled Loculo autoportante; both of which are incorporated herein by reference in their entireties.

FIELD OF THE INVENTION

The present invention concerns a self-supporting loculus, in particular a loculus made of light, stackable plastic material and which can be constrained with other loculi of the same type for erecting cemetery structures.

KNOWN ART

In the field of cemetery constructions, it is known to erect structures, named columbaria, comprising a plurality of loculi, i.e. of niches or horizontal cells intended to accommodate the coffins of the deceased. In today's city cemeteries, the loculi are assigned in concession for a given period of time, generally of one or more tens of years. At the end of the concession, the remains of the deceased are returned to relatives or placed in common ossuaries in the absence of a renewal.

Generally, the loculi are parallelepiped-shaped with a single front access, through which the coffin is inserted; following the burial, the front access is sealed with a front panel such as to sealingly isolate the inner volume delimited by the loculus. In fact, the law generally requires the loculi to seal off the fluids that possibly came out of the bodies as a condition.

The most widely used construction technique, at least in the recent past and defined as traditional, provides to implement columbaria made of bricks, cement or concrete, possibly by assembling prefabricated loculi made as individual, double, in blocks or comb artifacts etc., of thicknesses between 3 cm and 10 cm.

This technique allows to achieve sturdy and durable columbaria, although also involving various disadvantages, primarily among all the excessive weight which forces to create adequate bases or foundations in the construction sites. A further limit is given by the fact that both cement and concrete are porous materials and thus scarcely impermeable; this circumstance forces the builder to make additional works or to refinish the loculi, such as to achieve the impermeability required by laws. Clearly, such interventions have negative affect on the cost of the finished work and can anyhow involve mistakes during the implementation.

In more recent times, further techniques, defined as modern, were suggested for building columbaria, especially thanks to the diffusion of light materials with respect to cement, such as for example fiberglass, aluminum, steel and some plastic materials.

For example, single-body fiberglass loculi, i.e. made in one piece from a mold and not by assembling panels, and so-named paneled solutions instead achieved by assembling, i.e. by joining fiberglass panels, were suggested.

The single-body fiberglass loculi ensure the impermeability but in order to be produced, in particular in order to be able to be extracted from the mold, they must have a truncated pyramid shape tapered towards the bottom; thus, to be up to standard, they must be oversized and this inevitably involves an increase in the overall volumes. Moreover, this type of loculus is neither self-supporting nor stackable; in order to make columbaria, it is necessary to build a sturdy supporting rack, generally made of metal—for example steel—and to position the loculi one on top of the other, by making sure each loculus leans on a ledge of the rack. In order to ensure that possible fluids are collected within the loculus, without coming out, the rack is made with slightly inclined ledges such as the loculi implemented are also inclined, with the front access slightly raised with respect to the opposite bottom wall of the loculus.

Clearly, it is desirable to simplify the implementation and to be able to arrange self-supporting loculi, i.e. which maintain their relative shape, are stackable and do not require a supporting rack.

The fiberglass loculi with panels ensure the perfect inner sizing without affecting the outer volumes since they do not have to be extracted from a mold but are actually achieved by joining several panels one with the other. In practice, they have a perfect parallelepiped shape. The inclination towards the bottom, for collecting the fluids, is provided by a shaped panel inserted into the loculus, which acts as a collecting tank. Generally, the fiberglass loculi with panels are self-supporting; they only require a metal supporting rack in few situations. During the implementation, the previously coupled fiberglass panels are sealed manually with silicone products. It is clear that the quality of the insulation achievable depends on the skills of the operator in charge of the implementation, in the sense that the final result could be affected by human error and the loculus or the columbarium could not be perfectly sealed and impermeable, as required by the laws.

A further example of the modern construction technique is constituted by loculi made of steel or aluminum. This type of loculi is made in a factory, by folding and welding steel or aluminum sheets and by sealing the joint surfaces with silicone materials, thus achieving a module that is transported to the cemetery for being implemented. This type of loculus is characterized by an optimal inner sizing: the construction technique ensures compliance with the project measures. However, since the sealing is carried out by hand also in this case, the perfect impermeability is not ensured. Moreover, the modules made of steel or aluminum are not self-supporting since the sheets used for making them are thin: consequently, the implementation requires, as in the event of fiberglass loculi, the use of supporting racks with the adequate inclination for collecting fluids at the bottom wall of the loculi.

Single-body loculi made of a polymeric material, mainly polyethylene PE or polypropylene PP, with molding techniques were also suggested. These loculi also ensure the impermeability since they are made as a single body, without joints, but they must be made with a truncated pyramid shape tapered towards the bottom to be extracted from the respective molds; consequently, they must be oversized in the front part to be up to standard and this involves an undesired increase in the overall volumes and a higher than needed columbarium. The single-body loculi made of plastic material are not self-supporting and must be combined with metal supporting racks. The inclination towards the bottom is determined, similarly to the previous cases described, by the supporting rack. With respect to the single-body loculi made of fiberglass, the weight is slightly less.

BR102018011313 describes a substantially box-shaped single-body loculus made of a plastic material. The side walls are made with ribs to provide the loculus with a resistance sufficient such as to make it self-supporting and stackable, as shown in the respective FIG. 7.

WO 95/31624 describes a loculus having the characteristics of the preamble of claim 1.

ES 2536333 describes a loculus provided with an inclined base for collecting liquids at the corner between the base and the vertical bottom wall. Alternatively, the base can be horizontal and the loculus is provided with an inclined inner ledge.

US 2008/196225 describes a stackable loculus made not as a single body but assembled by joining walls made of a plastic material.

U.S. Pat. No. 5,894,699 describes a solution known in the art, which provides for the making of a supporting structure, such as metal carpentry.

SUMMARY OF THE INVENTION

Object of the present invention is thus to provide a simple to make and implement single-body loculus made of a light plastic material which is simultaneously self-supporting and reliable as far as the impermeability is concerned and which is also stackable and allows to effectively collect liquids.

The present invention thus concerns a loculus according to claim 1.

In particular, the loculus according to the present invention is substantially box-shaped, with a leaning base acting as flooring and intended to directly support a coffin, vertical side walls, a vertical bottom wall, a front opening opposite the bottom wall and an upper wall acting as a ceiling. The loculus is made as a single body, i.e. is devoid of joints or welding between the side walls, the bottom wall, the leaning base and the upper wall. This characteristic ensures the sealing of liquids; in fact, the absence of joints or welding to be manually sealed reduces to zero the risk of liquid leaks due to poorly made sealing.

The loculus is made of a plastic or polymeric material but is also self-supporting and does not require an outer supporting rack, unlike the known solutions. This result is achieved by implementing at least the vertical side walls with ribs or ribbing, or by implementing the vertical side walls corrugated.

The loculus is stackable with the leaning base supported by the upper wall of the underlying loculus, such as to quickly and simply erect columbaria of a desired height.

The leaning base is inclined towards the bottom wall and is configured as a tank for collecting liquids, which is integrated within the loculus itself. Possible liquids will thus be collected at the corner between the bottom wall and the leaning base.

Advantageously, the upper wall is inclined towards the bottom wall with the same inclination as the leaning base. In addition to having the loculus stackable and configured to effectively collect liquids, this allows to fit the loculi one with the other with a simple shape coupling.

In particular, the leaning base protrudes outwards with respect to the lower perimeter of the loculus, like an inclined plane, and the upper wall defines a step or recess with the side walls and bottom wall, and the leaning base of the loculus overlying is inserted into said step or recess, thus creating a shape coupling. In practice, the loculus is wedge-shaped at the bottom and is inserted into the upper recess of an identical loculus.

Thus, in the preferred embodiment, the vertical side walls of the loculus are not flat but are shaped with stiffening ribs or ribbing or are corrugated, and this geometric characteristic provides to the loculus with a compression strength and thus a static-load resistance greater than what is possible to find, for example, with single-body polyethylene loculi having flat walls instead.

The solution suggested thus addresses the demand for modern single-body loculi devoid of joints or welding, that are simple to implement and self-supporting, i.e. devoid of supporting rack or equivalent voluminous metal carpentry elements. In other words, this is a solution which provides the advantages of the known solutions, but without the respective disadvantages.

In an embodiment, the bottom wall is also made with stiffening ribs or ribbing or is corrugated.

Generally, the ribs or ribbing can be formed at the outer surface of the walls, thus leaving the inner surface flat, or, vice-versa, the ribs or ribbing can be formed at the inner surface of the walls, thus leaving the outer surface flat or, still, the ribs or ribbing can be formed both on the inner surface of the walls and on the outer surface.

Preferably, the ribs or ribbing extend vertically and uninterruptedly from the lower perimeter of the loculus to the upper perimeter of the loculus, i.e. without interruptions.

In the preferred embodiment, the minimum thickness of the vertical walls is 5 mm and the maximum thickness is 10 mm.

Preferably, the loculus is made of polyethylene although other polymeric materials are generally appropriate, such as polypropylene, for example.

In the preferred embodiment, the loculus comprises mechanical means for anchoring to other identical loculi, in order to firmly join several loculi in a horizontal direction. This characteristic, together with the fact that the loculus is stackable, allows to implement columbaria which extend both in height and in width, in accordance with the desired sizes.

Preferably, the mechanical means just described are at least partially incorporated into the material of the loculus, in the sense that the loculus is achieved with molding techniques and the mechanical anchoring means have at least one portion which stays embedded, incorporated and held in the material of the loculus, as if it were integral with the loculus itself.

Preferably, the mechanical anchoring means comprise a plurality of first plates at least partially embedded in the material of the loculus, each at a corresponding outer corner of the loculus, and corresponding second plates outside the loculus, which can be screwed to the first plates of two adjacent or overlapping loculi. This way, it is possible to join several loculi one another, such as to form a structurally solid columbarium.

The loculus preferably further comprises the respective closing panel for closing the front opening. Said mechanical means can comprise elements for anchoring the closing panel, for example pressure plates which can be screwed to the mechanical means for pressing the closing panel against the edge of the front opening. The mechanical means can further comprise screwable elements whose function is to keep the loculi in place and to prevent a loculus from being able to slip backward or forward when a coffin is inserted or extracted.

BRIEF LIST OF THE FIGURES

Further characteristics and advantages of the invention will become clearer in the review of the following detailed description of a preferred, although not exclusive, embodiment, illustrated by way of example and without limitations with the aid of the accompanying drawings, in which.

DETAILED DESCRIPTION OF THE INVENTION

Figure 1:
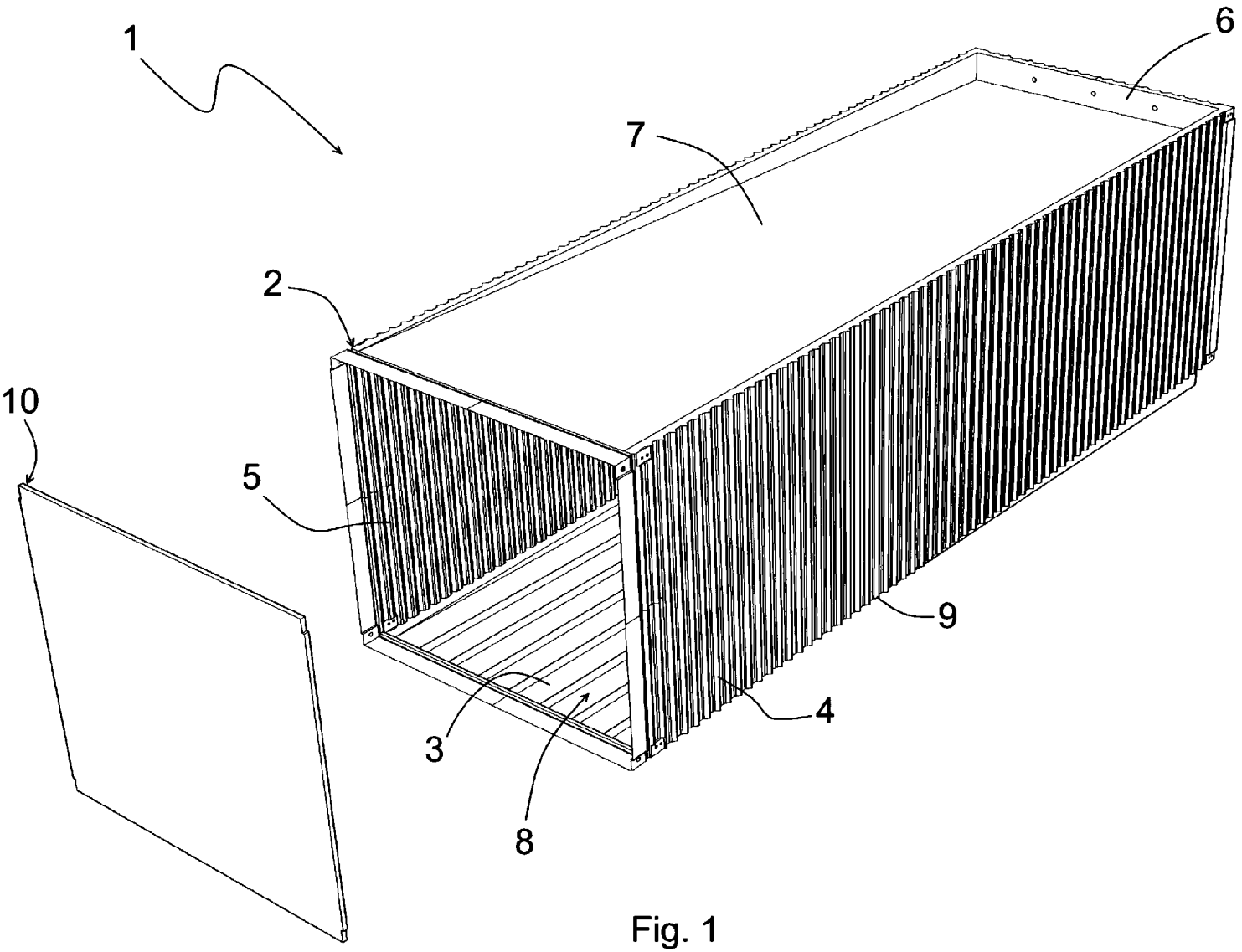
FIG. 1 is a top perspective view of a loculus according to the present invention.

FIG. 1 shows a perspective of a loculus 1 according to the present invention, comprising a single-body box-shaped body 2 and a front closing panel 10.

The body 2 of the loculus is defined by a leaning base 3, a right vertical side wall 4, a left vertical side wall 5, a bottom wall 6 and an upper wall 7. The leaning base 3 and the walls 4-7 are made in one piece, as a single body, and are thus devoid of welding, seals, joints, etc. The front opening 8 of the loculus, through which the remains of the deceased are inserted, is opposite the bottom wall 6; in other words, a coffin is intended to slide on the leaning base 3 during the burial.

The body 2 of the loculus 1 is intended to be closed by the front closing panel 10, as will be described hereunder.

The loculus 1 shown in the figures is formed by molding a plastic material, preferably polymeric and even more preferably polyethylene.

At least the vertical side walls 4 and 5, and also the bottom wall 6 in the example shown, are stiffened with ribs or ribbing 9 extending without interruptions from the lower perimeter of the loculus 1 up to the upper perimeter. Alternatively, the walls 4-6 can be made corrugated.

The stiffening ribs 9 extend vertically and, in fact, give sufficient stiffness to the body 2 of the loculus 1 for making it self-supporting.

In the example shown in the figures, the stiffening ribs 9 are both on the outer surface of the walls 4-6 and on the respective inner surface, but the solution with stiffening ribs 9 on only one of the two inner/outer surfaces, whereas the other surface stays flat, is also conceivable.

In the example shown in the figures, the vertical walls 4-6 have a thickness ranging from 5 mm to 10 mm. For example, the loculi 1 produced with a thickness of 10 mm are mainly intended to be laid down in cement or concrete in the absence of additional works and can thus replace all the solutions defined as "modern" by the operators of the field. The loculi 1 with a thickness of 5 mm are instead a valid alternative to those projects where so-named "traditional" solutions are already present, i.e. made of bricks, and when in fact desiring to replace or improve a part of the loculus.

In the loculus 1 shown in the figures, the thickness is constant between the valleys and ridges of the stiffening ribs 9.

The stiffening ribs 9 are preferably all equal one another but can generally differ in shape and size between one wall and another, for example between the bottom wall 6 and the side walls 4-5, or also on the same wall, for example they can be bigger in the proximity of the front opening 8 and of the bottom wall 6 with respect to the central area. Generally, the pitch between the stiffening ribs 9 can also be constant, as in the example of the figures, or variable, with stiffening ribs 9 spaced further away in some areas and closer in others.

The loculus 1 shown in the figures is stackable. The upper wall 7 is inclined with respect to a horizontal plane which intercepts the upper edge of the front opening 8. Advantageously, the leaning base 3 is also inclined with the same inclination as the upper wall 7. Thus, the shape of the body 2 of the loculus 1 is box-shaped but not truncated cone shaped.

Figure 2:
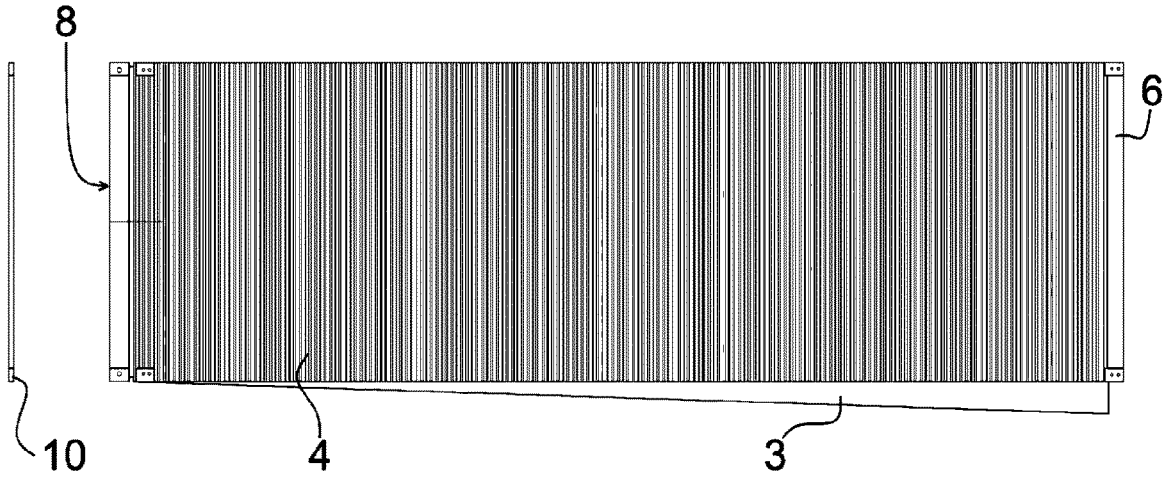
FIG. 2 is a side and elevation view of the loculus shown in FIG. 1.

FIG. 2 shows the loculus 1 in a side and elevation view: observing this figure, it can be noted how the leaning base 3 is an inclined plane, with an inclination oriented towards the bottom wall 6, protruding below the body 2 of the loculus 1, i.e. protruding beyond the lower perimeter, like a wedge. This characteristic is clearer in FIG. 3.

Figure 3:
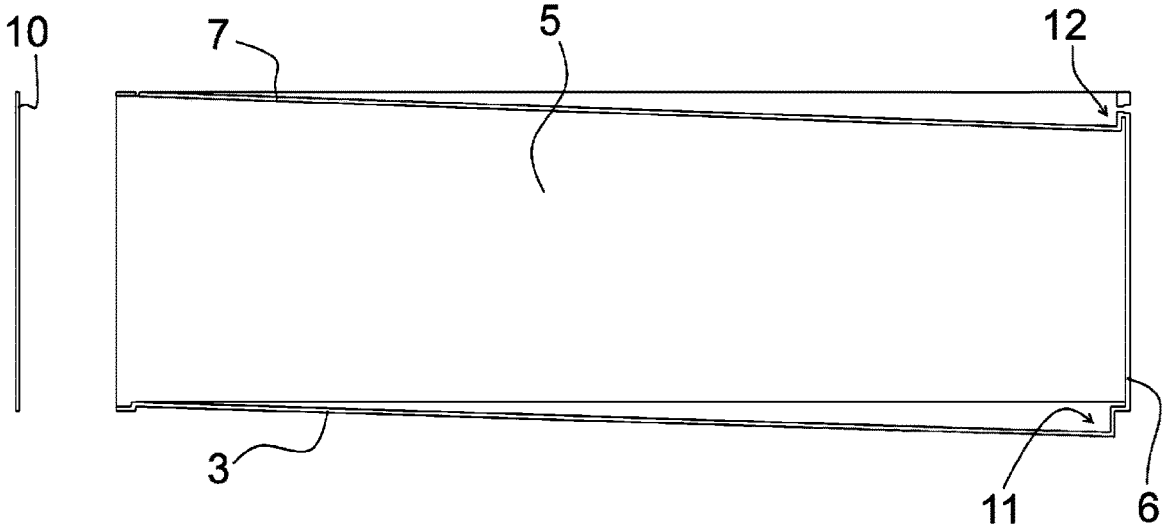
FIG. 3 is a sectional schematic view of the loculus shown in FIG. 1, considered on a median vertical plane of the loculus.

FIG. 3 is a vertical sectional schematic view of the loculus 1, i.e. a view considered on a vertical sectional plane (parallel to the side walls 4-5) passing at the center of the leaning base 3. As can be noted, the upper wall 7 and the leaning base 3 have the same inclination, i.e. are parallel. Possible liquids are collected at the lower and back corner 11. Consequently, when two loculi 1 are overlapped, the leaning base 3 of the overlying loculus 1 leans on the upper wall 7 of the underlying loculus 1 and an interlocking is defined at the back and upper corner 12.

Figure 4:
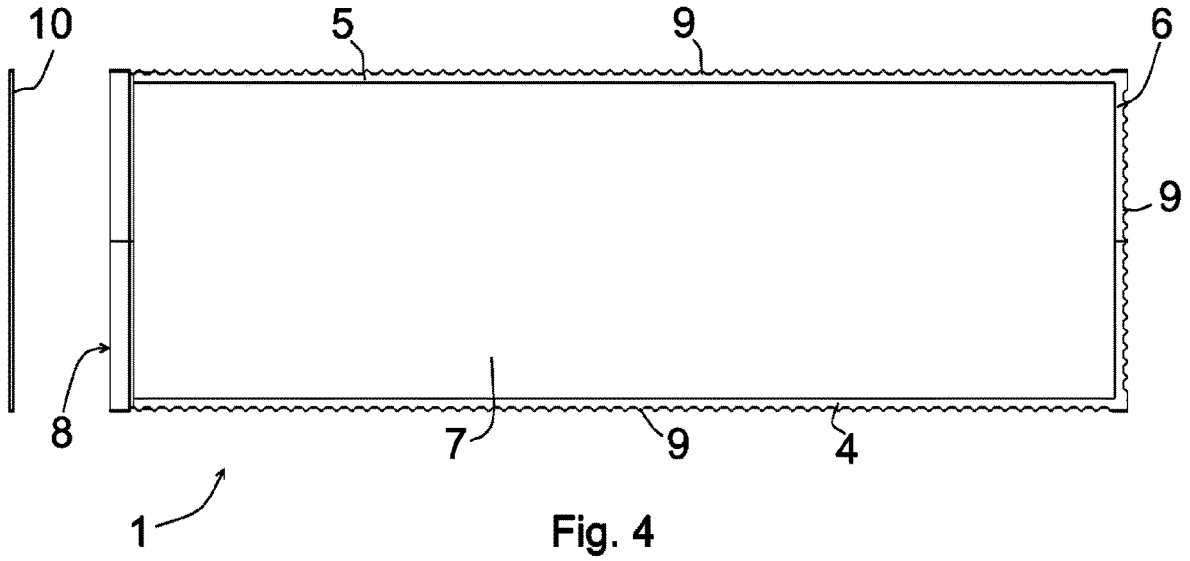
FIG. 4 is a top plan view of the loculus shown in FIG. 1.

FIG. 4 shows the loculus 1 in a top plan view. From this figure, it is possible to realize how the stiffening ribs 9 extend vertically at regular pitch, i.e. orthogonally to the surface of the sheet, on the side walls 4, 5 and on the back wall 6.

Figure 5:
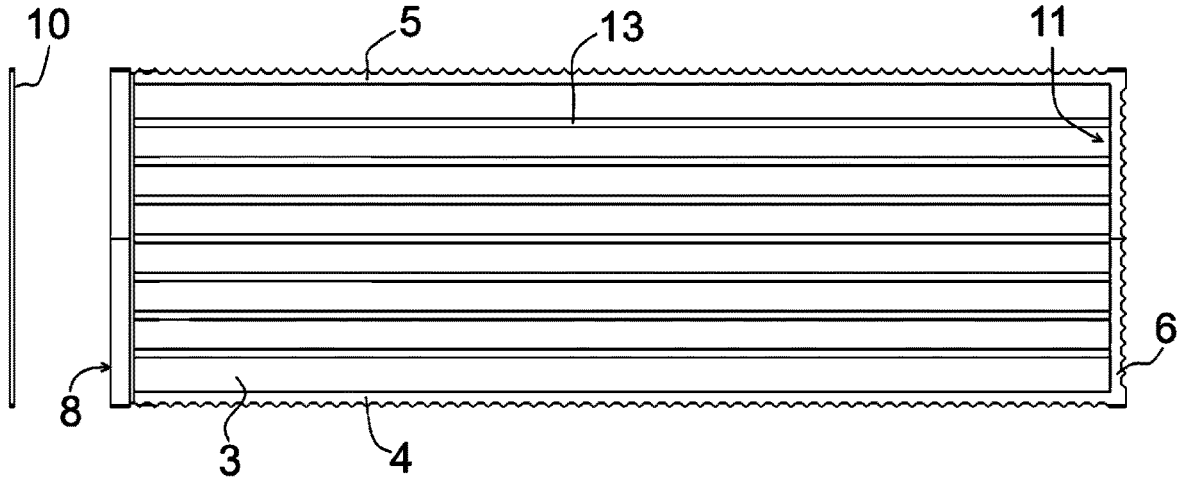
FIG. 5 is a sectional view of the loculus shown in FIG. 1, taken on a median horizontal plane of the loculus.

FIG. 5 is a sectional view considered on a horizontal plane. The leaning base 3, on which the grooves 13 used to drain possible liquids towards the lower and back corner 11 are formed, is visible from the top.

Figure 6:
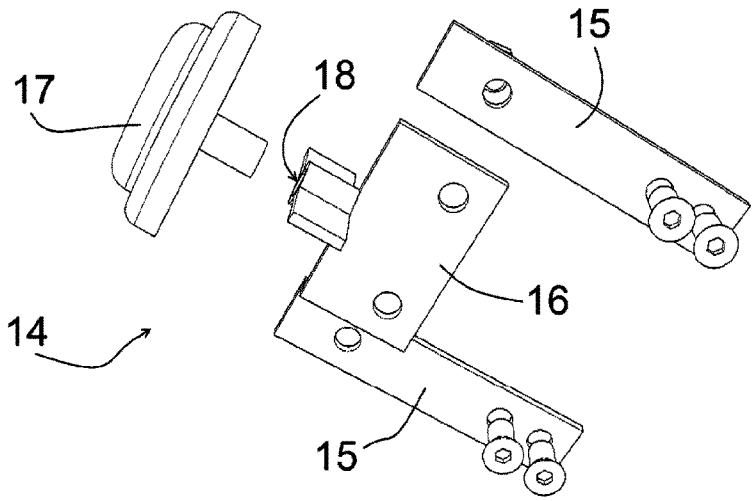
FIG. 6 is a perspective and exploded view of an accessory of the loculus shown in FIG. 1.

FIG. 6 shows, in perspective, a mechanical means assembly 14, whose function is to allow the anchoring of several loculi 1 such as to make a columbarium. In particular, the mechanical anchoring means 14 comprise first brackets 15 screwed to the body 2 of the loculi 1, such as to define an anchoring point integral with the body 2 itself, and at least one second bracket 16 which can be screwed to the first brackets 15 by staying in an intermediate position between two adjacent or overlapping loculi. The threaded holes for screwing the first brackets 15 can be formed, for example, by incorporating threaded rivets while molding. An anchoring element 17, in particular a pressure disc, can be screwed to a corresponding second bracket 16 into a threaded hole 18 thereof, such as to exert pressure on the marble coating of the loculus 1 and to ensure the stable positioning thereof.

Figure 7:
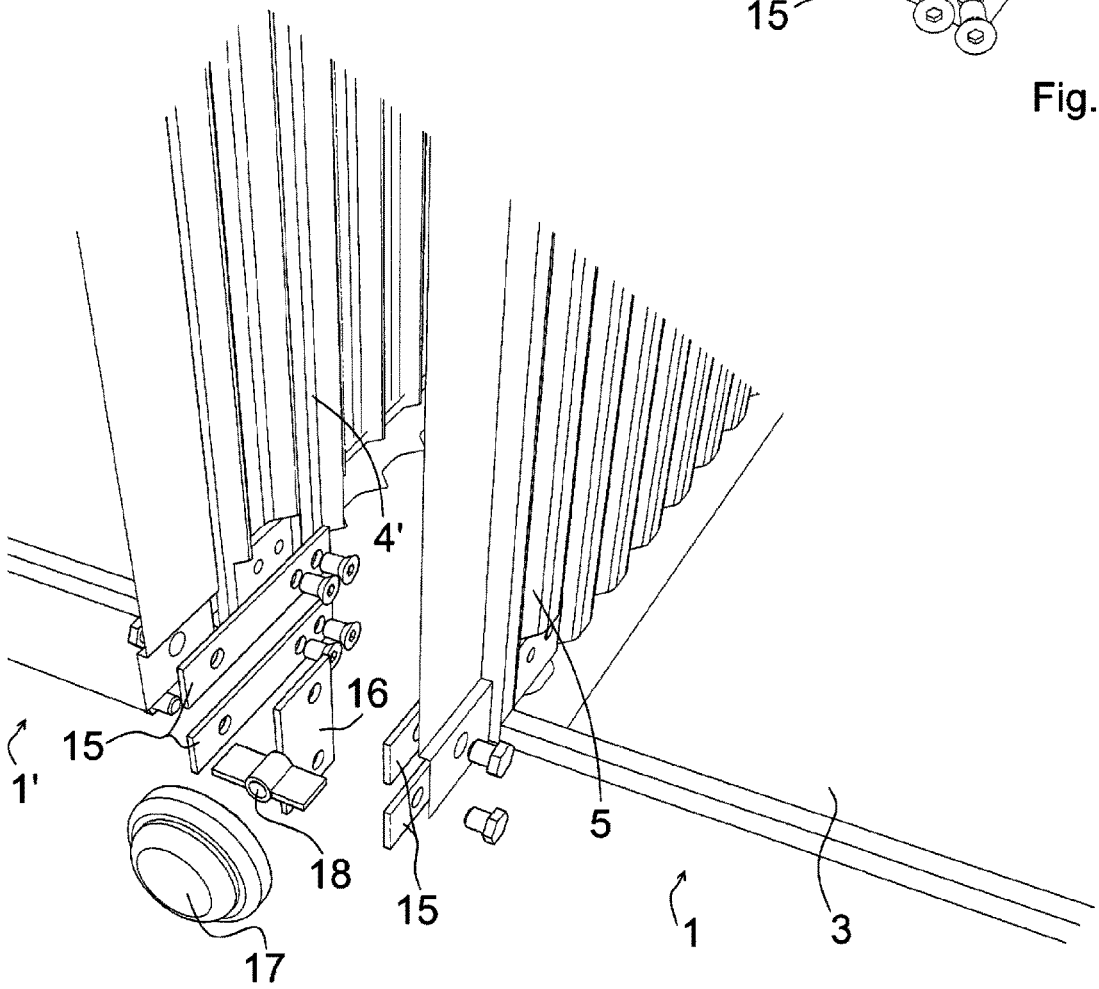
FIG. 7 is a perspective and partial view of a detail of the loculus shown in FIG. 1 and of a loculus adjacent thereto as they are being joined.

FIG. 7 shows, in perspective and in detail, two identical loculi 1, 1' side by side and ready to be anchored one another by using mechanical anchoring means 14. The right vertical side wall 4' of the loculus 1' is placed alongside the left vertical side wall of the loculus 1, by screwing the brackets 15 and 16, such as to create a strong constraint between the loculi 1, 1'. The pressure disc 17 is screwed into the hole 18 for keeping the loculi 1, 1' in place.

Figure 8:
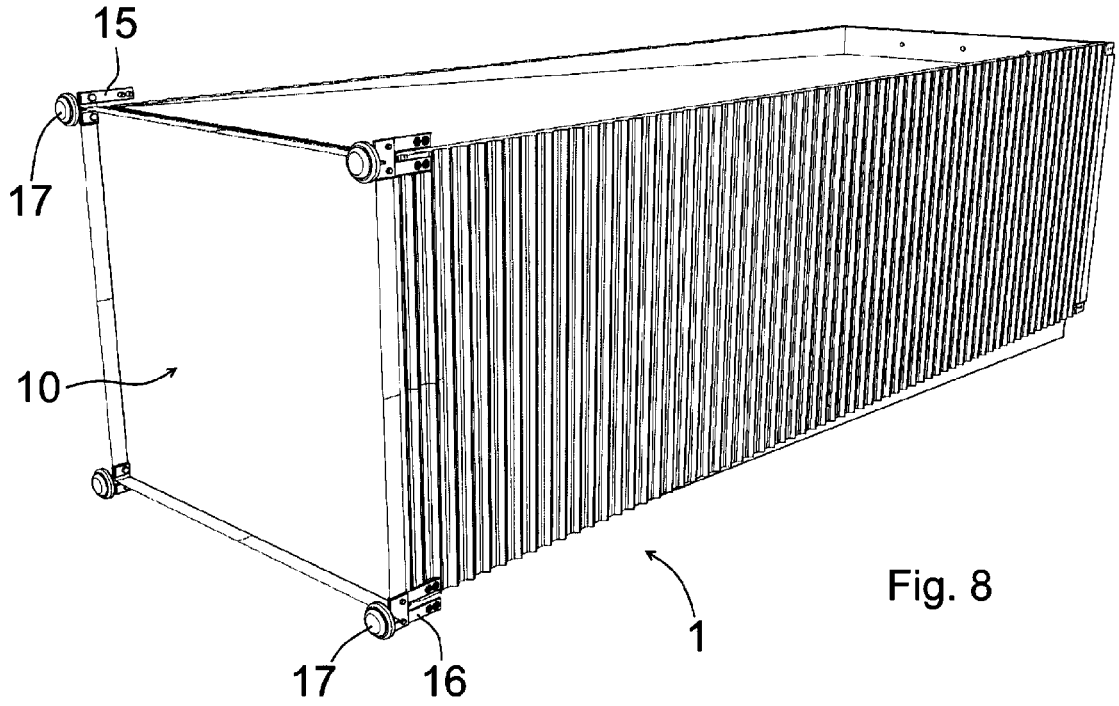
FIG. 8 is a perspective view of the loculus shown in FIG. 1, provided with mechanical means for anchoring to other loculi.

FIG. 8 shows this circumstance: the loculus 1 is shown, in a front perspective, with the opening 8 closed by the front closing panel 10. The discs 17 are shown already screwed, even though the stony coating is not drawn for more clarity.

Figure 9:
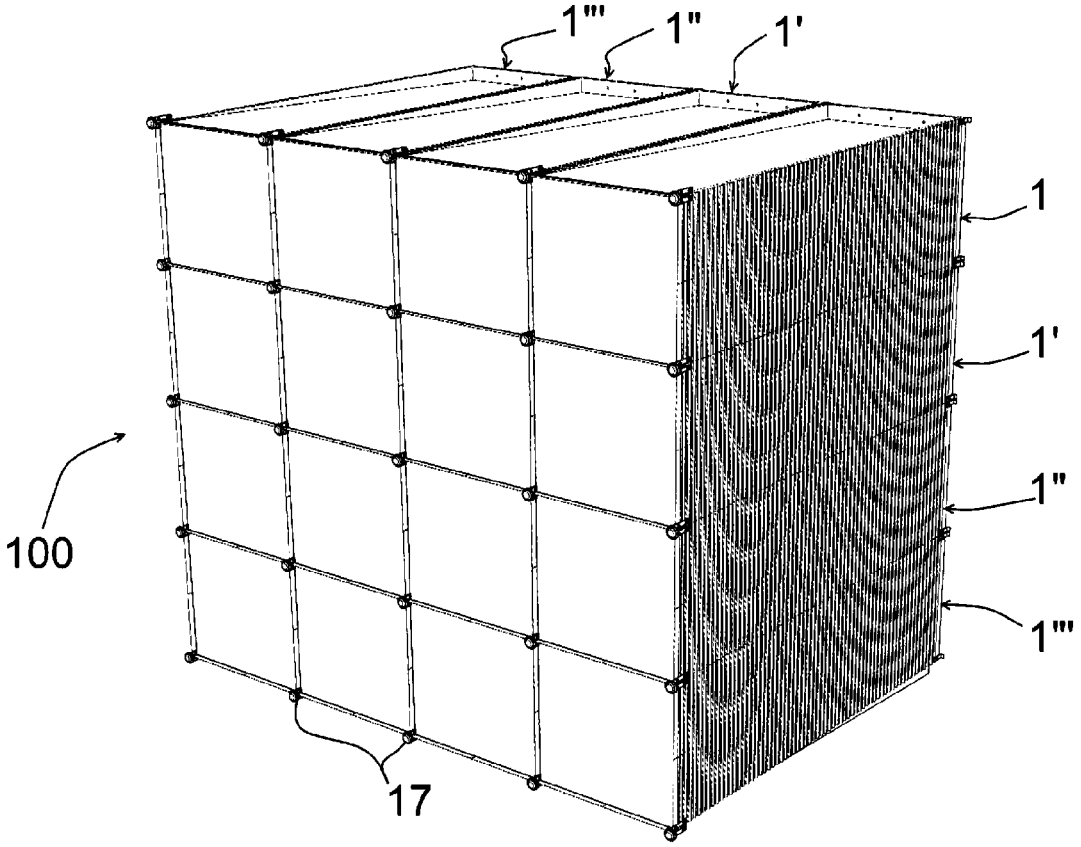
FIG. 9 is a perspective view of a columbarium formed by joining several loculi identical to the loculus shown in FIG. 1, in a closed configuration.

FIG. 9 shows, in a front perspective, a columbarium 100 made by vertically constraining a plurality of other identical loculi 1', 1", 1'" to the loculus 1 by means of the mechanical means 14.

Figure 10:
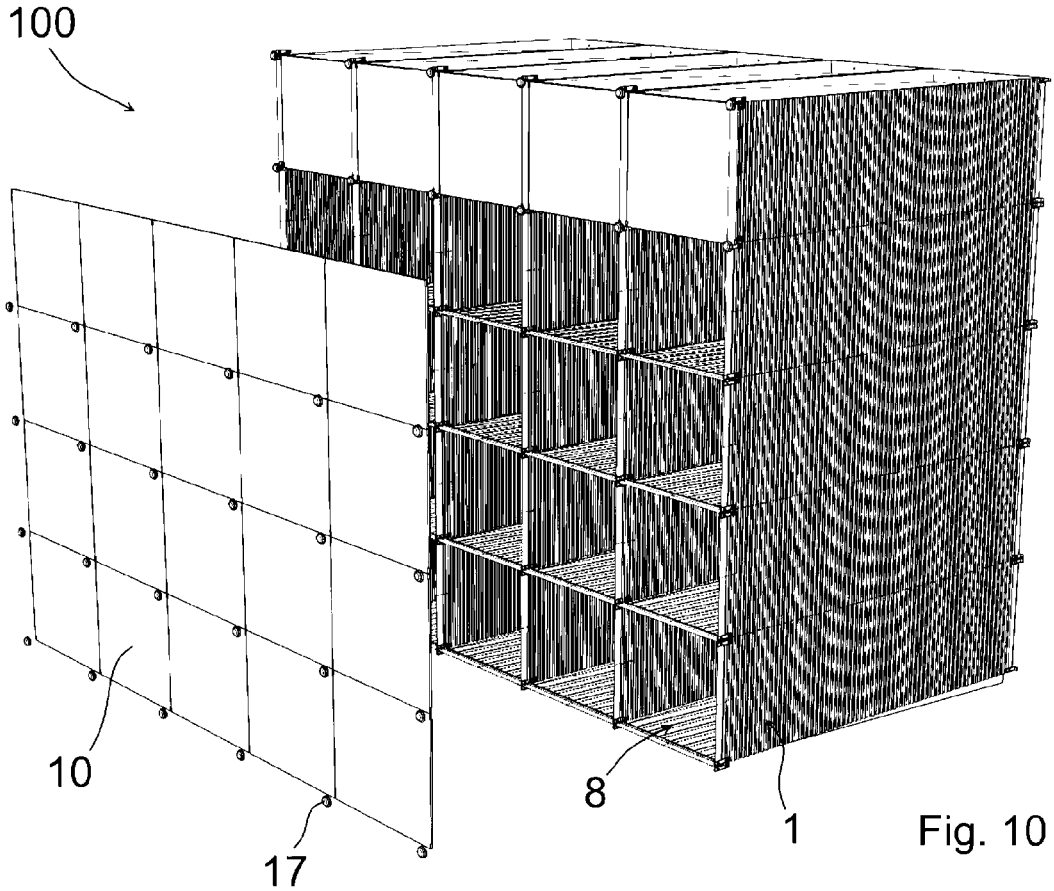
FIG. 10 is a perspective view of a columbarium formed by joining several loculi identical to the loculus shown in FIG. 1, being closed.

FIG. 10 shows the columbarium 100 with the upper loculi already sealed with the respective front panels 10 and the remaining loculi 1 in the process of being closed; the respective front panels 10 are about to be positioned at the front opening 8 of the respective loculus 1.

Figure 11:
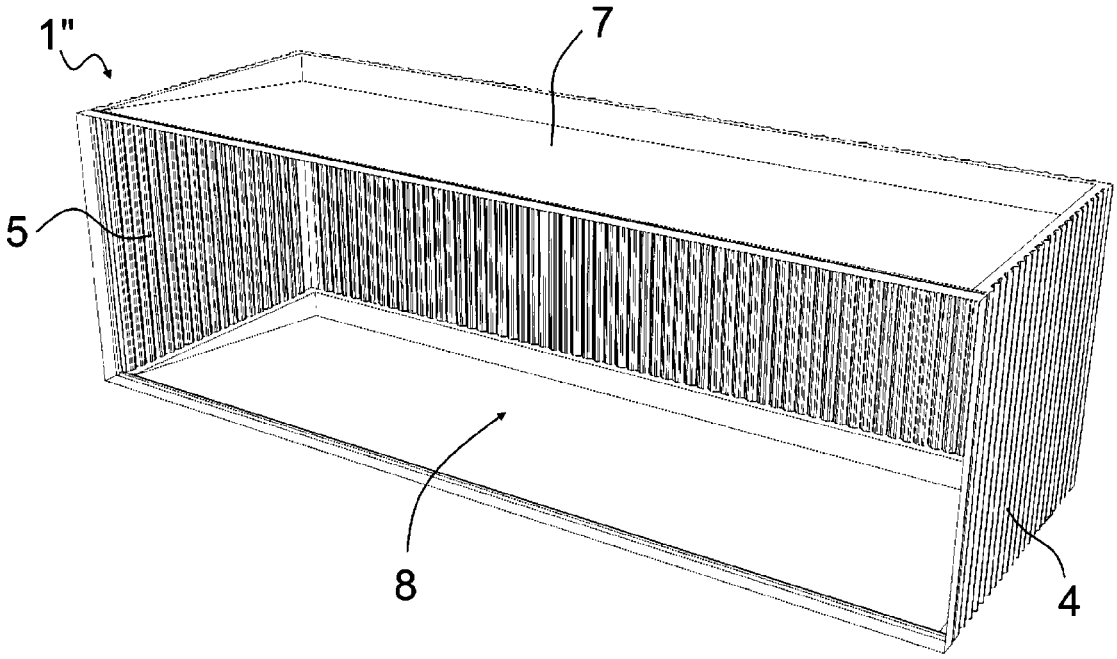
FIG. 11 is a top perspective view of a second embodiment of the loculus according to the present invention.

FIG. 11 shows, in a perspective top view, a second embodiment of the loculus 1" according to the present invention. The loculus 1" is different from the loculus 1 simply in that the front opening 8 is at the long side of the loculus 1".

The invention claimed is:

1. A single-body loculus (1, 1") made of a plastic material, with a leaning base (3) for leaning a coffin, vertical side walls (4, 5), a vertical bottom wall (6), a front opening (8) opposite the bottom wall (6) and an upper wall (7), wherein the side walls (4, 5) are made with ribs or ribbing (9) or are corrugated, and the loculus (1) is self-supporting, wherein the loculus (1, 1") is stackable with the leaning base (3) supported by the upper wall (7) of the underlying loculus (1), and wherein the leaning base (3) is inclined towards the bottom wall (6) and defines a tank for collecting liquids, characterized in that the upper wall (7) is inclined towards the bottom wall (6) with the same inclination as the leaning base (3).

2. Loculus (1, 1") according to claim 1, wherein the bottom wall (6) is made with ribs or ribbing (9) or is corrugated.

3. Loculus (1, 1") according to claim 1, wherein said ribs or ribbing (9) extend uninterruptedly from the lower perimeter of the loculus (1) to the upper perimeter of the loculus (1).

4. Loculus (1, 1") according to claim 1, wherein the minimum thickness of the vertical walls (4-6) is 5 mm and the maximum thickness is 10 mm.

5. Loculus (1, 1") according to claim 1, wherein the leaning base (3) protrudes outwards with respect to the lower perimeter of the loculus (1), like an inclined plane, and the upper wall (7) defines a step or recess (12) with the side walls and bottom wall (6), and the leaning base (3) of the loculus (1) overlying is inserted into said step or recess (12), thus creating a shape coupling.

6. Loculus (1, 1") according to claim 1, made in one piece by molding and devoid of joints or welding.

7. Loculus (1, 1") according to claim 1, made in polyethylene.

8. Loculus (1, 1") according to claim 1, devoid of outer supporting racks.

9. Loculus (1, 1") according to claim 1, comprising mechanical means (14) for anchoring to other identical loculi.

10. Loculus (1, 1") according to claim 9, wherein said mechanical means (14) are at least partially incorporated into the material of the loculus.

11. Loculus (1, 1") according to claim 9, wherein said mechanical means (14) comprise a plurality of first plates (15) at least partially embedded in the material of the loculus (1), each at an outer corner of the loculus (1), and corresponding second plates (16) outside the loculus (1), which can be screwed to said first plates (15) of adjacent or overlapping loculi.

12. Loculus (1, 1") according to claim 9, comprising a panel (10) for closing the front opening (8) of the loculus (1), and said mechanical means (14) comprise anchoring elements for anchoring the closing panel (10).

13. Loculus (1, 1") according to claim 9, wherein said mechanical means (14) comprise elements (17) which implement a stop element and which prevent the longitudinal displacements of the loculi (1) once constrained to each other.

* * * * *